US007383656B2

(12) United States Patent
Bojalad et al.

(10) Patent No.: US 7,383,656 B2
(45) Date of Patent: Jun. 10, 2008

(54) PROCESS FOR MANUFACTURING DOUBLE BARREL SHOTGUN BARRELS, AND THE RESULTING DOUBLE BARRELS

(76) Inventors: Joe Bojalad, 101 Gatehouse Dr., Moon Township, PA (US) 15108; Karl C. Lippard, 3259 Electra Dr. south, Colorado Springs, CO (US) 80906

( * ) Notice: Subject to any disclaimer, the term of this patent is extended or adjusted under 35 U.S.C. 154(b) by 127 days.

(21) Appl. No.: 11/344,493

(22) Filed: Feb. 1, 2006

(65) Prior Publication Data

US 2007/0175078 A1 Aug. 2, 2007

(51) Int. Cl.
*F41A 21/00* (2006.01)

(52) U.S. Cl. ..... 42/76.1

(58) Field of Classification Search ..... 42/76.1, 42/76.01, 76.02; 89/14.7, 14.8
See application file for complete search history.

(56) References Cited

U.S. PATENT DOCUMENTS 3,159,903 A * 12/1964 Eves ..... 89/14.8

* cited by examiner

*Primary Examiner*—Michael J. Carone
*Assistant Examiner*—Gabriel J Klein
(74) *Attorney, Agent, or Firm*—Michael C. Martensen; Hogan & Hartson LLP

(57) ABSTRACT

A method for manufacturing double barrel shotgun barrels, including the steps of providing an elongated metal stock material having a first end and a second end, forming two index holes in both the first end and the second end of the material, forming a first and second bore hole through the material, and then profiling the material into a desired gun barrel profile. 16. 479 Double barrel shotgun barrels formed from a single piece of elongated solid metal stock material according to the process of the invention are also taught.

12 Claims, 3 Drawing Sheets

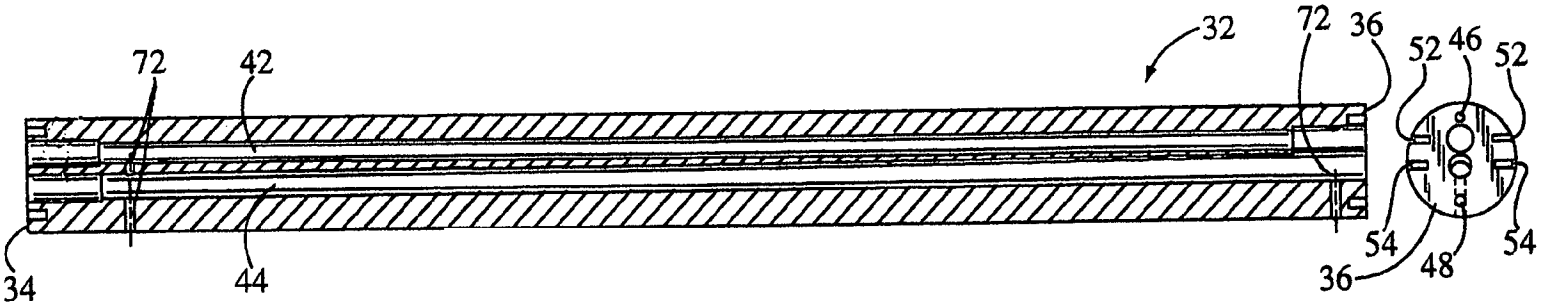
Fig. 10
FIG. 9
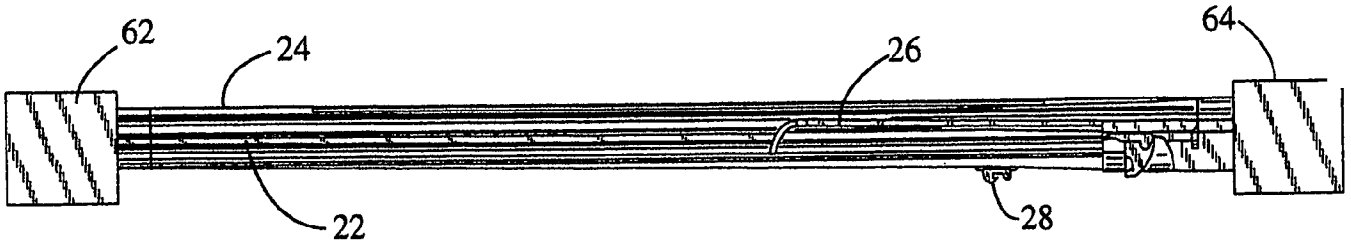
FIG. 11
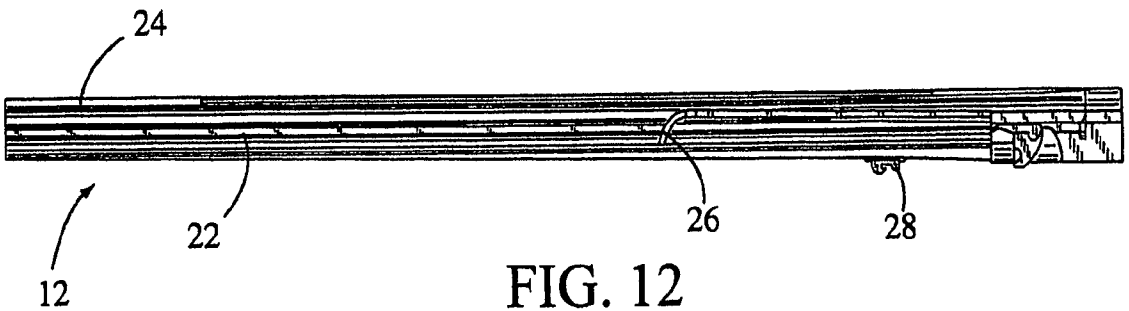
FIG. 12

PROCESS FOR MANUFACTURING DOUBLE BARREL SHOTGUN BARRELS, AND THE RESULTING DOUBLE BARRELS

BACKGROUND OF THE INVENTION

1. Field of the Invention

This invention relates generally to a process for metal working to produce double barrel shotgun barrels, and, more particularly it relates to a process for manufacturing over/under and side-by-side shotgun barrels from a single piece metal stock, and also to the resulting monolithic shotgun barrels so produced.

2. Description of the Prior Art

Double barrel shotguns are long known in the art. There are two basic types of double barrel shotguns being manufactured today. A first type of double barrel shotgun is commonly referred to as a "Chopper Lump" (English terminology) or a "Demibloc (Italian terminology)" barrel, and will herein be referred to as "Demibloc". Demibloc barrels are formed from two metal tubes or single barrels, preferably of steel, that are of a length sufficient to form a shotgun. As a first significant step, the two metal tubes soldered together to form a roughly joined double barrel. The resulting double barrel is then filed, machined and otherwise worked in multiple steps using the skills and labor of multiple trades and crafts people. For example, as a first step a "Joiner" joins the two individual metal tubes and then solders them together along substantially their entire lengths. An "Actioner" fits and files the rough barrel to fit and match a separate action or firing mechanism to which the double barrel is to be attached. A "Striker" files the surfaces of the joined rough double barrel pieces to a desired finish. A "Straightener" straightens or regulates the joined barrels and also adjusts or bends the individual barrels by eye into a relative position to allow each barrel to shoot a projectile straight and also into a desired converging shot pattern at a given distance. A "Rib installer" solders the top sighting rib onto the combined double barrel tube, and also solders side ribs on either side of the tubes between the two barrels to secure them in the desired relative position.

Finally, a "Bluer" treats the combined double barrel to produce the desired oxidized blue-black coating onto the double barrel.

The second type of double barrel shotgun is commonly referred to as a "Monobloc" (Italian term). A Monobloc double barrel shotgun consists of an action block of metal, preferably steel, fitted to the action or firing mechanism of the shotgun. The Monobloc is preformed to carry at least two receiving holes designed to accept a pair of separate barrel tubes. Each separate tube is then set into and soldered to a receiving hole of the action block so that each protrudes from the action block, and is of a length sufficient to be formed into a shotgun. The two tubes are then held in position with wire or by a fixture and are then roughly tacked together along their entire lengths with solder. Then, the joined barrels are straightened or "Regulated" by hand into a relative position to allow each barrel to shoot a projectile straight and also into a desired converging or overlapping shot pattern at a prescribed distance. Next, the barrels are sent to a "Rib installer" to solder the top sighting rib and side ribs between the barrels that hold the tubes in place. The rough barrels are then sent to a "Striker" or "Finisher" to finish the surfaces of the barrels by filing and sanding. Finally, the barrels are sent to "Bluer" for bluing and final finish.

In addition, double barrel shotgun barrels are formed by the Demibloc and by the Monobloc process in over/under (O/U) and side by side (S/S) shotgun barrels It can therefore be seen, that the process of making a double barrel, whether by the Demibloc or the Monobloc process consists of a large number steps performed by many crafts an trades people, and, as a practical matter requires a great deal of time, say up to two and one half years to complete.

Accordingly, there exists a need for a process for manufacturing double barrel shotgun barrel systems which allows what have heretofore been many dissimilar trades to perform manufacturing and machining and finishing steps quickly, efficiently and in harmony in order to arrive at a finished double barrel shotgun barrel within a required specification. Additionally, a need exists for a process for manufacturing shotgun barrels which is quick and inexpensive and easy to replicate with precision. Furthermore, there exists a need for a process for manufacturing double barrel over/under and/or side by side shotgun barrels which allow a broad range of different types of barrels to be produced using substantially the same single piece of metal stock and material blank. There is a further need to precisely produce such double barrel over/under and/or side by side shotgun barrels quickly and without the use of the labor of multiple trades or craftsmen.

SUMMARY OF THE INVENTION

The present invention teaches methods for manufacturing double barrel shotgun barrels. In one embodiment the method comprises providing an elongated metal stock material of a given length and of sufficient height and width to be formed into a double barrel shotgun, the metal stock material having a first end and a second end. So long as the metal stock material meets those size requirements, it may be round, or square, or rectilinear or irregular in cross section, the desired starting cross section being easily milled or otherwise formed on the metal stock material. For purposes of simplicity it will be assumed that the metal stock material is round, or cylindrical or rectilinear in cross-section. As a first significant step in creating the double barrel of the present invention, two separate and spaced apart index markers are formed at both the first end of the metal stock material and at the second end of the metal stock material. The second index marker formed in the second end of the metal stock material is opposed to and aligned precisely linearly with the first index marker formed in the first end of the metal stock material longitudinally through the length of the metal stock material. The second index marker formed in the second end of the metal stock material is also opposed to and aligned linearly with the first index marker formed in the first end of the metal stock material longitudinally through the length of the metal stock material. Each pair of opposed first and second index markers serve to define what will be the centers of to-be-bored holes. In addition, and as is explained below, the index markers allow the metal stock material to be moved from one machine to another during various steps of the process of the present invention.

A first substantially straight guide element is then formed linearly along one surface of the external longitudinal length of the metal stock material. The first guide marker runs in a substantially straight line between the first end of the metal stock material and the second end of the metal stock material. A second guide marker is then formed linearly along the external longitudinal length of the metal stock material, and runs in a substantially straight line between the first end of the metal stock material and the second end of the metal stock material. However, the second external guide marker is spaced apart from and on a surface opposed to the first guide marker, and as explained and greater detailed below, is angled relative to the first external guide marker at what will be the angle of convergence of the to-be-formed bore holes. Then, using the first and second pairs of index markers, the first and second holes to be bored are established A first bore hole is formed linearly through the length of the metal stock material, the first bore hole being aligned with and guided by the first guide marker. Then, the second pair of index markers are used to establish the location of the second bore hole to be formed linearly through the length of the metal stock material, the second bore hole being aligned with and guided by the angle of the second guide marker, and therefore at the predetermined angle of convergence at a given distance from the end of the barrels. In practice, the angle of convergence between the first projectile hole and the second projectile hole is usually in the range of about 0.35° and about 0.40°. All of these steps are achieved with a minimum of handling; require no skilled trades or craftsmen. Then, the double barrel thus formed may be profiled and finished with a minimum of handling and without requiring skilled trades or crafts people.

As used with the present invention, the "index markers" may be holes or raised points, or any other form of index marker. Similarly, the "guide element" may be grooves, rails, or any other form of guide element.

BRIEF DESCRIPTION OF THE DRAWINGS

FIG. 9 is an elevational sectional side view of the metal stock material of FIG. 7, but now further processed and illustrating first and second bore holes formed through the stock material, with fixture holes shown formed at the left end of both the first and second bore holes, but at only the first bore hole on the right end, and further illustrating holes drilled into the material for circulation of coolant;

FIG. 10 is a left side view of the cylindrical metal stock material of FIG. 9, the left end view being similar thereto, but for the absence of a fixture hole in the second bore hole on the right end;

FIG. 11 is an elevational side view of the material of FIG. 9, but now further processed and illustrating, but for the left and right blocks of stock material, the now nearly complete profiled over/under double barrel shotgun barrel constructed in accordance with the process of the present invention; and FIG. 12 is an elevational side view of the material of FIG. 11, but now further processed and illustrating, the left and right blocks of stock material removed, to form a now complete over/under double barrel shotgun barrel, as shown in perspective in FIG. 1, and constructed in accordance with the process of the present invention.

DETAILED DESCRIPTION OF THE PREFERRED EMBODIMENTS

Figures 1, 2:
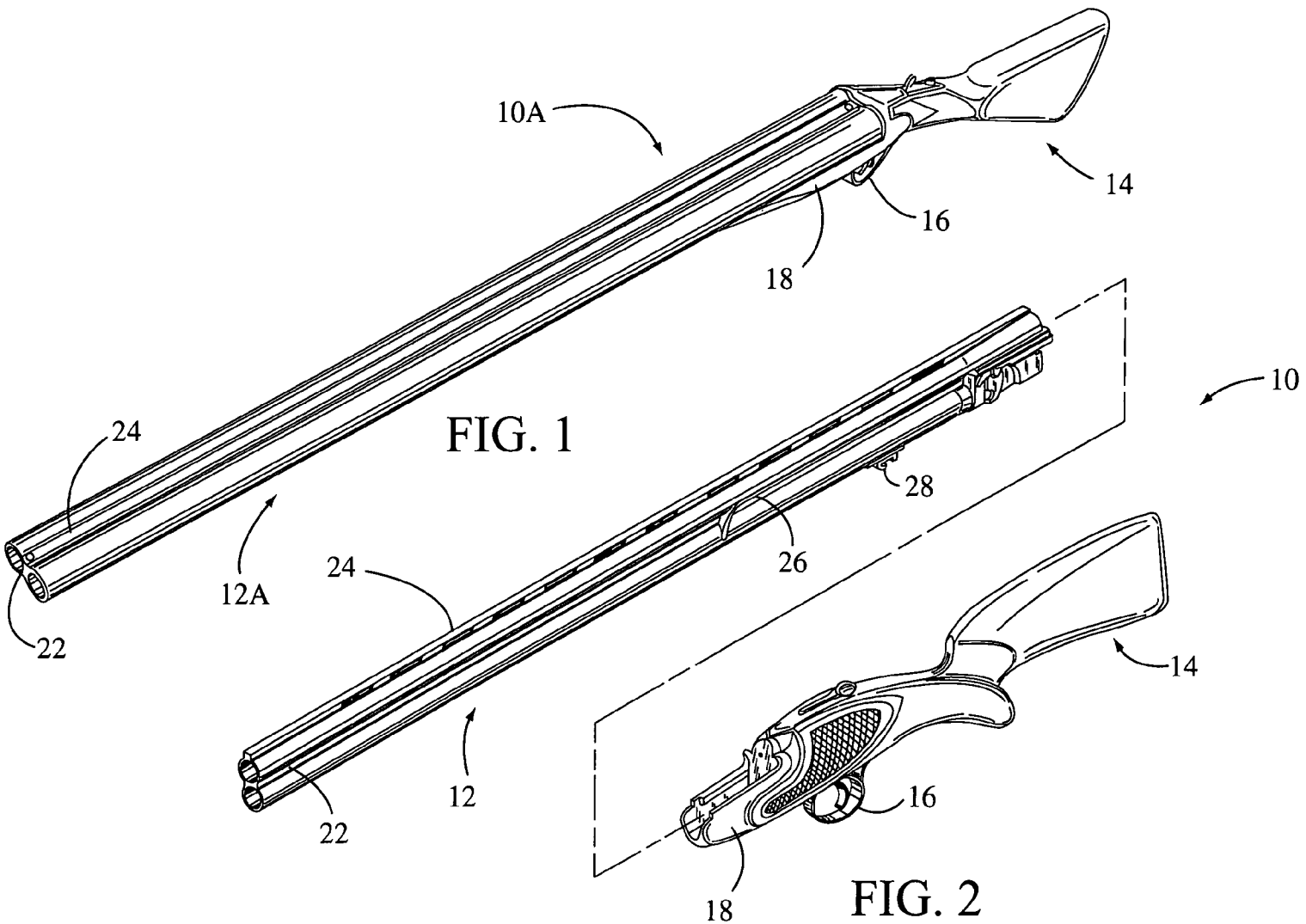
FIG. 1 is an exploded perspective view illustrating a state-of-the-art stock and trigger mechanism in relation to a finished over/under double barrel shotgun barrel constructed in accordance with the process of the present invention.
FIG. 2 is a perspective view illustrating a state-of-the-art stock and trigger mechanism shown joined to a finished side-by-side double barrel shotgun barrel constructed in accordance with the process of the present invention.

Referring first to FIG. 1, illustrates a perspective view illustrating a complete double barrel shotgun 10A having a side by side (S/S) double barrel 12A constructed in accordance with the process of the present invention. FIG. 2 provides an exploded perspective view illustrating an over/under (O/U) double barrel shotgun 10 including a state-of-the-art butt stock 14 having a trigger mechanism 16 and a forend 18, in relation to an O/U double barrel 12 constructed in accordance with the process of the present invention, as detailed below. Illustrated on the O/U double barrel 12 are a standard joining or side rib 22 between the two barrels, a top rib 24 , a false rib 26 and a forend latch 28 carried by and produced as parts of a finished over/under double barrel shotgun barrel 12 constructed in accordance with the process of the present invention. Like parts on O/U shotgun 10 and shotgun S/S 10A have like numbers.

Figure 3:
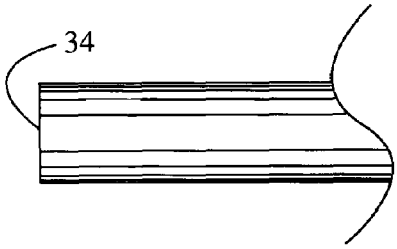
FIG. 3 is an interrupted side elevational view illustrating a typical solid cylindrical metal stock material before it has undergone any of the steps of the method of the present invention to produce a double barrel shotgun barrel.
Figure 4:
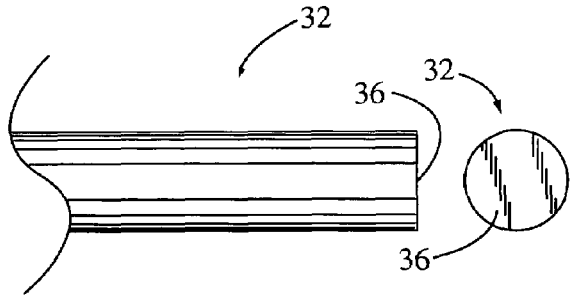
FIG. 4 is a right end elevational view of the cylindrical metal stock material of FIG. 3 before it has undergone any of the steps of the method of the present invention, the left end view being a mirror image thereof.
Figure 5:
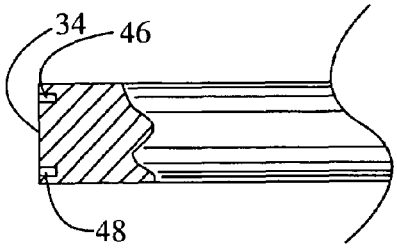
FIG. 5 is an elevational side view of the cylindrical metal stock material of FIG. 3, partially in section at its left and right ends to illustrate a pair of index holes at its left and right ends.
Figure 6:
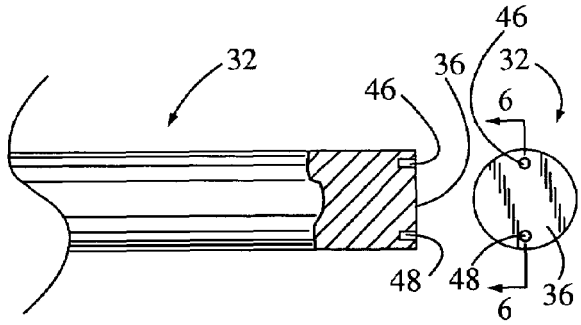
FIG. 6 is a right end elevational view of the cylindrical metal stock material of FIG. 5 illustrating the pair of index holes, the left end view being a mirror image thereof.

The process for manufacturing over/under (O/U) 12 or side by side (S/S) 12A shotgun barrels of the present invention begins with obtaining a single piece of metal stock material 32, as shown in FIGS. 3 and 4. In the preferred practice of the present invention, the metal stock material 32 is a solid piece of metal, preferably of art known gun barrel grade steel. In the embodiment shown in FIGS. 3 and 4, stock material 32 is substantially circular in cross-section, although square or rectangular or other shaped stock material 32 may be used in the method of the present invention. In addition, it is within the scope and teaching of the method of the present invention to produce shotgun barrels 12 or 12A from other metal stock materials having other workable cross-sections. In any event, the starting metal stock material 32 is generally solid and elongated and has a first end 34 and a second end 36. For ease of operation and handling, both first end 34 and second end 36 of the solid metal stock material 32 are formed or cut flat and substantially orthogonal to the linear length of the stock material 32, and both first end 34 and second end 36 are formed substantially parallel to one another. Stock material 32 is of a length, height and width sufficient to be formed into and produce a double barrel O/U 12 or S/S 12A shotgun barrel.

The process of the present invention for manufacturing double barrel O/U or S/S shotgun barrels 12 or 12A according to the present invention is comprised of several steps, as well as optional steps. The first step, after obtaining an appropriate metal stock material 32, is determining the ultimate angle of convergence of the first and second two to-be-bored projectile holes 42 and 44, respectively (see FIGS. 9 and 10). As discussed below, the angle of convergence of projectile holes 42 and 44 is determined by the laws of ballistics and physics. The production of the angle of convergence for projectile holes 42 and 44 begins with forming pairs of index markers 46 and 48 on the first and second ends 34 and 36 of metal stock material 32.

Now, in order to produce and replicate O/U or S/S double barrel barrels accurately and consistently, two precisely located and spaced apart index markers 46 and 48 are formed at the first end 34 of the solid metal stock material 32, and two precisely located and spaced apart matching index markers 46 and 48 are also formed at the second end 36 of the solid metal stock material 32. In preferred embodiments each pair of two index markers are a pair of spaced apart holes 46 and 48, formed, for example, by drilling into the first end 36 and a second end 46 and 48 of solid substantially cylindrical metal stock material 32. The first pair of index holes 46 and 48 formed in the first end 34 of the metal stock material 32 are preferably aligned linearly with the second pair of index holes 46 and 48 formed in the second end 36 of the metal stock material 32. Each pair of index holes 46 and 48 are aligned longitudinally through the length of the metal stock material 32 with the opposed pair of index holes 46 and 48. In the preferred practice of the present invention, the two index markers 46 and 48 at the first end 34 and the two index markers 46 and 48 at the second end 36 of solid stock material 32 are located between about 2.0 inches apart and about 2.5 inches apart. While the index markers 46 and 48 are herein noted to be holes, and specifically to be drilled holes, the index markers may be formed in any other manner, for example as projections, and by any other method.

Figure 7:
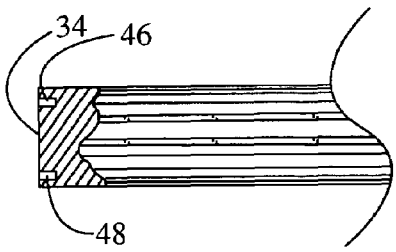
FIG. 7 is an elevational sectional side view of the metal stock material of FIG. 5, and now further processed and illustrating first and second converging guide grooves formed in the outer surface of the stock material.
Figure 8:
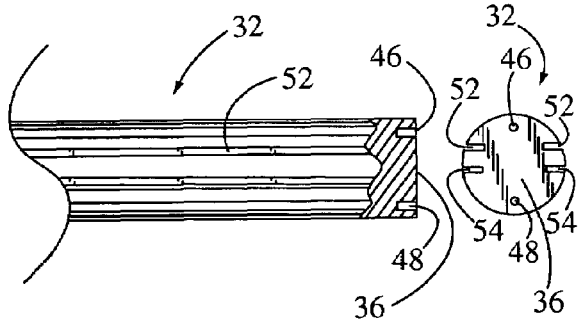
FIG. 8 is a right end elevational view of the cylindrical metal stock material of FIG. 7 illustrating the first and second converging guide grooves as well as the pair of index holes, the right end view being substantially a mirror image thereof, but with the guide grooves slightly closer to one another.

Next, based on the locations of index markers 46 and 48, the exterior of metal stock material 32 is then profiled, using equipment and methods as detailed below, including the formation of accurately positioned converging external guides 52 and 54. Converging external guides 52 and 54 are located relative to one another at what will be the angle of convergence of the first and second to-be-bored projectile holes 42 and 44. As shown in FIGS. 7 and 8, such external guides are preferably in the form of straight linear grooves 52 and 54 for use in guiding the boring of the converging bore holes 42 and 44. A pair of first straight guide grooves 52 are formed linearly, but opposed to one another along both sides of the external longitudinal length of the metal stock material 32. The first guide groove elements 52 run in a substantially straight line between the first end 34 and second end 36 of metal stock material 42. A second pair of guide groove elements 54 are then formed linearly, but also opposed to one another along both sides of the external longitudinal length of the metal stock material 32. along the external longitudinal length of the metal stock material, and also runs in a substantially straight line between the first end 34 of the metal stock material 32 and the second end 36 of the metal stock material 32. However, the second pair of external guide grooves elements 54 is spaced apart from, and are angled relative to the first pair of external guide groove elements 52. The angle of the second pair of external guide grooves 54 will serve to guide the angle of convergence of the to-be-formed bore holes 42 and 44.

Then, as illustrated in FIGS. 9 and 10, two small, say ¼ inch circulation holes 72 are drilled and tapped, say about 2.5 inches to about 3 inches from the ends 34 and 36 of the metal stock material 32, and into the first and second projectile bores 42 and 44. The circulation holes 72 allow for circulation of coolant by art known means during the profiling and Electrical Discharge Machining (EDM) process as described below. The foregoing not withstanding, circulation holes 72 and the step of circulating coolant can be omitted, if desired.

Then, after the location and setup of index markers 46 and 48 at ends 34 and 36 of solid metal stock material 32 is used to produce external guide groove elements 52 and 54 for either O/U 12 or S/S 12A shotgun barrels, external guide groove elements 52 having precise locations and angles of convergence are used to locate two to-be-bored projectile bore holes 42 and 44 that provide the desired overlap pattern that at a given distance. This is accomplished using the first pair of external guide groove elements 52 for alignment, a first bore hole 42 is formed linearly through the longitudinal length of the metal stock material 32, first bore hole 42 is formed using any suitable boring system. Then, metal stock material 32 is moved and placed into a second alignment with the boring system using second alignment guide groove elements 54, and second bore hole 44 is then formed linearly through the longitudinal length of the metal stock material 32 also using any suitable boring system, but at the predetermine angle of convergence with first bore hole 42, as shown in FIGS. 9 and 10. It is within the teaching and tolerances of the present invention to produce second bore hole 44 before first bore hole 42. Thus, the two to-be-bored converging holes 42 and 44 are precisely located and bored based on the positions of the four index holes 46 and 48 holes and the external guide groves 52 and 54. In the alternative, but not as simply, index holes 46 and 48 can be used, without forming external guide groove elements 52 and 54 to align a moveable machining table or other device to establish an offset angle between bore holes 42 and 54, for example with Computer Assisted Drawings (CAD) converted to tool paths equipment, or print specification.

The method of actually forming bore holes 42 and 44 in stock material 32 is not critical to the practice of the present invention. However, what ever type of bore hole forming system is used, converging external guides 52 and 54 will preferably be used to select and guide the angle of convergence between bore holes 42 and 44. For example, since the early eighteenth century a fixed, non-moveable single axis hand turned boring or drilling machine has been used to produce bore holes, and may be used to produce bore holes 42 and 44 in the practice of the present invention. This can be accomplished by cutting two longitudinal grooves like 52 and 54 in the surface of stock material 32, which grooves represent the desired convergent directions of bore holes 42 and 44. However, in the preferred process of the present invention, state-of-the-art automated power boring machines such as Computer Numerical Controlled (CNC) machines are used with converging external guides 52 and 54 to select and guide the angle of convergence between bore holes 42 and 44. As an important step in the process of the present invention, in order to accurately replicate bore holes from stock material 32 to stock material 32, one must mechanically establish the location of those bore hole centers. In the preferred practice of the present invention, those bore hole centers are locatable from index marker elements 46 and 48 which allow each piece of stock material 32 to be moved and repositioned on any boring machine, as the marker elements 46 and 48 serve as reference indexes that identify the correct location of the to-be-bored projectile holes 42 and 44 within the stock material 32, regardless of what type of boring machine was originally used. Once such converging external guides 52 and 54 are alternately placed on a machining table having a compatible locating element for aligning the boring element, and fixed into position, the boring machine hole line will be represented by the line of the guides 52 and 54. Therefore, in practice, when a first hole, say 42 is completed using external guides 52, the stock material 32 can then be placed in the second external guides 54, and the boring machine aligned to external guides 54, and bore hole 44 established with the desired angle of convergence. In each instance, the alignment of stock material 32 is established on the table and in the fixture by reference to index markers 46 and 48.

In the alternative, where the boring machine has very accurate moveable tables for positioning stock material 32, and where the centers of projectile holes 42 and 44 are locatable from index marker elements 46 and 48, the stock material 32 can be moved and positioned with respect to the boring tools so that and projectile bore holes 42 and 44 can be produced without reference to or use of converging external guides 52 and 54. Subsequently, the surface of stock material 32, as shown in FIGS. 9 and 10, is then profiled and machine finished to the profile shown in FIG. 11, but without removing unfinished end portions 62 and 64. Such profiling and finishing is easily completed using state-of-the-art CAD and other state-of-the-art machining tools, such as CNC machines and EDM processing. If desired or required, during the profiling and EDM machining processes, circulation holes 72 may be used to circulate coolant within bored projectile holes 42 and 44.

Finally, as shown in FIG. 12, end portions 62 and 64 are removed, for example by cutting them off to a specified length, and barrel 12 is completed to produce a now substantially complete O/U double barrel shotgun barrel 12 constructed in accordance with the process of the present invention. Of course, further finishing or customizing of the surfaces, and bluing or other final custom finish may be provided by time consuming art known means. It will be seen that barrel 12 as shown in FIG. 12 is the same as that shown in FIG. 12. In the practice of the method of the present invention the bored stock material is preferably transferred to a state-of-the-art lathe, not shown, for profiling. The holding fixture, also not shown, of the lathe is keyed to the two pairs of index holes 46 and 48 with matching pegs. The index holes 46 and 48 allow the true center of each of the to-be-formed converging bore holes 42 and 44 inside of the metal stock material 32 to be defined. Measurements from the center of bore holes 42 and 44 allows proper finish machining and profiling of the finished product, as shown in FIGS. 11 and 12. Such finishing of the bored gun barrel 12 or 12A is produced by extensive milling, preferably followed by electric discharge machining (EDM). In the EDM finishing step a mating pair of female electrode replicas, not shown, of the profile of the final external barrel are first made. The rough finished barrel is then compressed between the two electrodes and EDM machined until a highly finished external profile is attained. The end result is a barrel 12 or 12A that, in production, has required little to no hands on specialty human labor.

It is apparent, that by adjusting the orientation of the system by 90° in several of the steps discussed above, that a S/S double barrel shotgun barrel 12A can be produced. It should be noted that side and top ribs 22 and 24 are produced with and integral to the finished double barrel products.

In any event, it is clear that in the practice of the method of the present invention, the monolithic O/U or S/S double barrels are not made from a composite of two tubes or single barrels that are joined together, for example by soldering, to make a joined, but not monolithic double barrel. Nor is it necessary for single barrels to be joined together and then bent relative to one another during their joining by eye reckoning into position to a desired angle of convergence, as in the prior art Demibloc and Monobloc processes. Rather, since the starting stock material 32 for production of O/U or S/S double barrels is solid elongated metal stock material in which the two bore holes 42 and 44 are accurately formed having the desired angle of convergence within the solid metal stock material 32, and remains as a continuously joined monolith that is neither amenable to or capable of having its bore holes 42 and 44 bent relative to one another to adjust their angle of convergence. In addition, the bore holes 42 and 44 formed within the solid metal stock material 32 produced using the method of the present invention react differently to the harmonics waves of flexation that are generated during firing of a projectile through bore holes 42 and 44, as compared to the flexation produced by the counterpart state-of-the-art joined double barrel produced by conventional Demibloc and Monobloc methods of manufacture, and therefore the angles of convergence that have been determined for use with the prior art joined systems are not applicable to the angles of convergence required for the double barrel shotgun barrels produced by the method of the present invention. It is therefore understood that the determination of the angle of convergence of the two bore holes 42 and 44 produced by the method of the present invention is a key element to producing even and overlaying shot patterns at any given distance. Because of the above noted differences in the harmonics waves of flexation that are generated during firing of projectiles from shotgun barrels produced by the method of the present invention, the selection of the angle of convergence for an O/U or S/S barrel formed from solid metal stock material is also different from those known and used for double barrels produced by prior art Chopper Lump and Demibloc.

By using the indexing holes and other steps and techniques described herein, the shotgun barrels produced by the method of the present invention can be reproduced with precision for each to-be-produced shotgun barrel, thus making the shotgun barrels interchangeable from shotgun to shotgun. For the most part, double barrel shotgun barrels produced by prior art methods have required semi-precise machining for each individual shotgun system and further finished by hand, and are not interchangeable from shotgun to shotgun. Similarly, the center to center bored holes 42 and 44 can be produced in sizes that are compatible with a large number of double barrel shotgun barrels in use today of a like gauge. It will be appreciated that the double barrel gun barrels can be finished to assume different forms in accordance to the needs of a manufacturer or gunmaker. A particular profile of a gunmaker's barrel can be produced in either the O/U or S/S type barrels of the present invention.

Thus, the process of the present invention which produces a solid monolithic barrel with little or no hands on skilled labor replaces the Demibloc barrel manufacturing procedures that require multiple trades and a great deal of time to complete. By comparison, the process of making a solid block barrel according to the method of the present invention to produce a single complete one piece solid unit is simple and fast. For example, in the current practice, a Demibloc barrel which is made using a number of Tradesmen takes approximately two and one half years to complete. By comparison, the double barrel of the present invention can be reproducibly manufactured and completely finished in about eight to about 24 hours, depending on the sophistication of the machines used. However, in producing the completed form shown at FIGS. 1, 2 and 12, the process of the present invention eliminates substantially all of the trade crafts required in the process of making a Demibloc barrel. Further, by selection of premium steel, such as Vacuum Arc Remelt Steel, rarely used because of its difficult machining properties, it can reduce the explosive bursting defects of barrels made of lesser material, thereby potentially saving injuries, life and property. Further, the solid barrel process of the present invention eliminates the issue of solder joints coming loose with use or age. Since side and top ribs 22 and 24 are integral to the finished product, it also prevents them from delaminating, and the soldered joints from separating, as in a Demibloc system, which are common prior art problems. The monolithic barrel produced by the process of the present invention eliminates all of these failures, while at the same time improving barrel burst safety by as much as 700% depending on the metal material selected. Stated simply, seven stages and crafts of prior art Demibloc barrel manufacturing are eliminated by using the solid barrel process of the present invention, while the cost to make the barrel remains about the same or less, and is much quicker and totally reproducible. Furthermore, the double barrel shotgun barrels so produced have close and reproducible tolerances, can be made from one solid piece of steel and can be made to resemble a Monobloc piece design, and can be made as a solid barrel or designed in part to be soldered into an existing state-of-the-art action block, thereby producing a new two piece solid barrel design.

In addition, side by side barrels, single barrels, pistol barrels, rifle barrels, and double rifle barrels can also be produced using the process of the present application.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A method for manufacturing double barrel gun barrels, the method comprising:

providing an elongated solid metal stock material having a length dimension and a first end and a second end, said solid metal stock material being of sufficient length to produce a double barrel gun barrel;

forming a first pair of opposed index markers at both said first end and said second end of the solid metal stock material;

forming a second pair of opposed index markers at both the first end and the second end of the solid metal stock material, the second pair of index markers being spaced from the first pair of index markers at both the first end and the second end of the solid metal stock material, each said first and second index markers at said first end and said second end of the solid metal stock material providing indices for subsequently positioning said metal stock material for further processing;

forming a first projectile hole by boring through the solid metal stock material, the location of said first projectile hole being defined along its said length dimension by said first and second index markers at said first and second ends; and then forming a second projectile hole by boring through the solid metal stock material, the location of said second projectile hole also being defined along its said length dimension by said first and second index markers at said first and second ends, and spaced apart from said first projectile hole wherein said metal stock material carrying said first projectile hole and said spaced apart second projectile hole is machine profiled using machining equipment selected from cutting tools, grinding tools, material removing equipment, and polishing equipment, and combinations thereof forming a first external guide along the longitudinal length of the solid metal stock material; forming a second external guide along the longitudinal length of the solid metal stock material, said second external guide being spaced from said first external guide, and at an angle relative to said first external guide; forming a first projectile hole by boring through the solid metal stock material, the location of said first projectile hole being defined along its said length dimension by said first and second index markers at said first and second ends and aligned with said first external guide; and then forming a second projectile hole by boring through the solid metal stock material, the location of said second projectile hole being defined along its said length dimension by said first and second index markers at said first and second ends and aligned with said second external guide.

2. The method of claim 1 wherein said solid metal stock material is machine profiled using machining equipment selected from Computer Numerical Controlled machines (CNC) with Computer Assisted Drawings (CAD) converted to tool paths, and combinations thereof.

3. The method of claim 1 wherein said solid metal stock material is machine profiled and polished using Electrical Discharge Machining (EDM) equipment.

4. The method of claim 1 wherein said solid metal stock material is machine profiled and polished using machining equipment selected from Computer Numerical Controlled machines (CNC) with Computer Assisted Drawings (CAD) converted to tool paths, and Electrical Discharge Machining (EDM) equipment, and combinations thereof.

5. The method of claim 1 wherein the angle between said first external guide and said second external guide represents the angle of convergence between the first projectile hole and the second projectile hole.

6. The method of claim 5 wherein the angle of convergence between the first projectile hole and the second projectile hole is in the range of about 0.35° and about 0.40°.

7. The method of claim 1 including the step wherein said solid metal stock material is selected from the group consisting of round and rectilinear cross-section material.

8. The method of claim 1 wherein said solid metal stock material has a substantially round cross-section and has a diameter of between about 2.75 inches and about 3 inches.

9. The method of claim 1 wherein said solid metal stock material has a substantially rectilinear cross-section and has a diameter of between about 2.75 inches and about 3 inches.

10. The method of claim 1 wherein the length of the solid metal stock material is between about thirty-seven inches and about forty inches.

11. The method of claim 1 and further comprising the steps of:

positioning said solid metal stock material in a fixture of a boring apparatus, the fixture having a means for receiving said first external guide;

positioning said first external guide in said fixture at a desired angle with respect to said boring apparatus;

boring the first projectile hole through the solid metal stock material;

removing the solid metal stock material from the fixture;

positioning said second external guide in said fixture at a desired angle with respect to said first projectile hole and said boring apparatus; and then boring the second projectile hole through the solid metal stock material.

12. The method of claim 1 and further comprising the steps of drilling cooling fluid circulation holes adjacent the first end and the second end of the solid metal stock material.

* * * * *

UNITED STATES PATENT AND TRADEMARK OFFICE

CERTIFICATE OF CORRECTION

PATENT NO. : 7,383,656 B2
APPLICATION NO. : 11/344493
DATED : June 10, 2008
INVENTOR(S) : Joe Bojalad and Karl C. Lippard It is certified that error appears in the above-identified patent and that said Letters Patent is hereby corrected as shown below:

Column 9, lines 61-65 delete as shown:

"~~forming a first projectile hole by boring through the solid metal stock material, the location of said first projectile hole being defined along its said length dimension by said first and second index markers at said first and second ends; and then~~"

Column 9, lines 66-67 through column 10, lines 1-9 delete as shown:

"~~forming a second projectile hole by boring through the solid metal stock material, the location of said second projectile hole also being defined along its said length dimension by said first and second index markers at said first and second ends, and spaced apart from said first projectile hole wherein said metal stock material carrying said first projectile hole and said spaced apart second projectile hole is machine profiled using machining equipment selected from cutting tools, grinding tools, material removing equipment, and polishing equipment, and combinations thereof~~"

UNITED STATES PATENT AND TRADEMARK OFFICE

CERTIFICATE OF CORRECTION

PATENT NO. : 7,383,656 B2
APPLICATION NO. : 11/344493
DATED : June 10, 2008
INVENTOR(S) : Joe Bojalad and Karl C. Lippard It is certified that error appears in the above-identified patent and that said Letters Patent is hereby corrected as shown below:

Column 10, line 26 claim 9 after "guide" insert --and spaced apart from said first projectile hole wherein said metal stock material carrying said first projectile hole and said spaced apart second projectile hole is machine profiled using machining equipment selected from cutting tools, grinding tools, material removing equipment, and polishing equipment, and combinations thereof--

Signed and Sealed this

Thirtieth Day of June, 2009

John Doll

JOHN DOLL
*Acting Director of the United States Patent and Trademark Office*